US011519099B1

(12) United States Patent
Lupien et al.

(10) Patent No.: US 11,519,099 B1
(45) Date of Patent: Dec. 6, 2022

(54) BAST STALK ALIGNMENT FEED AND DECORTICATION SYSTEM

(71) Applicant: Bastcore, Inc., Homewood, AL (US)

(72) Inventors: John C. Lupien, Omaha, NE (US); Jonathan Bonner, Tuscaloosa, AL (US)

(73) Assignee: Bastcore, Inc., Homewood, AL (US)

( * ) Notice: Subject to any disclaimer, the term of this patent is extended or adjusted under 35 U.S.C. 154(b) by 0 days.

(21) Appl. No.: 17/083,280

(22) Filed: Oct. 28, 2020

Related U.S. Application Data

(60) Provisional application No. 62/927,018, filed on Oct. 28, 2019.

(51) Int. Cl.

| | |
|---|---|
| ***D01B 1/22*** | (2006.01) |
| ***D01B 1/24*** | (2006.01) |
| ***D01B 1/36*** | (2006.01) |
| ***D01B 1/32*** | (2006.01) |

(52) U.S. Cl.
CPC ..... *D01B 1/22* (2013.01); *D01B 1/24* (2013.01); *D01B 1/32* (2013.01); *D01B 1/36* (2013.01)

(58) Field of Classification Search
CPC ... D01B 1/14; D01B 1/22; D01B 1/24; D01B 1/26; D01B 1/32; D01B 1/36; D01B 1/40; D01B 1/42; D01B 1/46
USPC ..... 19/5 R, 10
See application file for complete search history.

(56) References Cited

U.S. PATENT DOCUMENTS

| | | | | |
|---|---|---|---|---|
| 1,200,615 A | | 10/1916 | Hubler | |
| 1,268,975 A | | 6/1918 | Hubler | |
| 1,299,946 A | | 4/1919 | Hubler | |
| 1,964,633 A | | 6/1934 | Haynes | |
| 1,973,583 A | | 9/1934 | Stone | |
| 1,981,575 A | | 11/1934 | Jeffrey | |
| 2,197,683 A | | 4/1940 | Burkardt | |
| 2,222,793 A | | 11/1940 | Burkardt | |
| 2,233,753 A | | 3/1941 | Burkardt | |
| 2,263,591 A | | 11/1941 | Patterson | |
| 2,264,236 A | | 11/1941 | Bokum | |
| 2,288,652 A | | 7/1942 | Simons | |
| 2,341,290 A | | 2/1944 | Reeves | |
| 2,402,634 A | | 6/1946 | Kaiser | |
| 2,404,457 A | | 7/1946 | Reeves | |
| 2,460,448 A | | 2/1949 | Cook | |
| 2,576,406 A | * | 11/1951 | Mccrae | D01B 1/14 19/12 |
| 3,872,545 A | | 3/1975 | Heino | |

(Continued)

FOREIGN PATENT DOCUMENTS

| | | | | |
|---|---|---|---|---|
| EP | 122769 A2 | * | 10/1984 | D01B 1/14 |
| FR | 1007525 A | * | 5/1952 | D01B 1/32 |
| GB | 249196 A | * | 3/1926 | D01B 1/40 |

*Primary Examiner* — Khoa D Huynh
*Assistant Examiner* — Aiying Zhao
(74) *Attorney, Agent, or Firm* — AdamsIP, LLC

(57) ABSTRACT

A plant stalk decortication apparatus and method are provided. The apparatus includes an alignment system in which a series of rotating spindles with blades attached to the spindles are positioned over a bed on which plant stalks are longitudinally aligned and conveyed by the blades. The apparatus also includes rollers and breakers downstream of the blades for crushing and breaking the plant stalks to cause the bast fibers and hurd to separate. The apparatus also includes a suction chamber that separates loose bast fiber from hurd chips formed by the breakers.

14 Claims, 10 Drawing Sheets

(56) References Cited

U.S. PATENT DOCUMENTS

| | | | | |
|---|---|---|---|---|
| 4,241,474 | A | 12/1980 | Doutre | |
| 5,447,238 | A | 9/1995 | Aldridge | |
| 5,447,276 | A | 9/1995 | Aldridge | |
| 5,507,073 | A | 4/1996 | Aldridge | |
| 5,507,074 | A * | 4/1996 | Chen | D01B 1/40 19/5 A |
| 5,906,030 | A * | 5/1999 | Leduc | D01B 1/16 19/24 |
| 6,079,647 | A | 6/2000 | Leduc | |
| 6,357,083 | B1 | 3/2002 | Stratton | |
| 7,152,610 | B2 | 12/2006 | Csavas | |
| 9,080,257 | B2 | 7/2015 | Lupien | |
| 2007/0044890 | A1 * | 3/2007 | Sherwood | A01D 82/02 156/62.2 |
| 2013/0167327 | A1 | 7/2013 | Lupien | |
| 2013/0276998 | A1 | 10/2013 | Park | |
| 2018/0103591 | A1 * | 4/2018 | Jin | A01F 29/12 |

* cited by examiner

BAST STALK ALIGNMENT FEED AND DECORTICATION SYSTEM

CROSS REFERENCES

This application claims the benefit of U.S. Provisional Application No. 62/927,018, filed on Oct. 28, 2019, which application is incorporated herein by reference.

FIELD OF THE INVENTION

The present invention relates generally to a plant stalk decortication system and method for stripping, removing, recovering, and sorting plant fiber and woody core from the vascular tissue of plant stalks.

BACKGROUND

Certain dicotyledonous plants, including examples such as hemp (*Cannabis stiva*), jute (*Corchorus* sp.), and kenaf (*Hibiscus cannabinus*), have woody stalks containing two main types of fiber useful for processing into various cellulosic products including, but not limited to, textiles, twine, rope, cordage, yarns, sorbents, pet bedding, and other similar products. These fiber types are longer fibrovascular bundle phloem fibers ("bast") located between the epidermis and inner woody core and short fibers contained in the core or stem of the plant ("hurd"). Phloem fibers are constituted from bundles of tube-like cell walls of various layers that may be much longer than the wood fibers. Phloem fibers also have higher crystalline cellulosic content, which makes them desirable for industrial processes.

These fibers may be produced through biochemical processes, including retting and enzymatic treatment, which results in an overall degradation and loss of hemicellulose, pectin, and lignin of the short hurd fiber making it less desirable for some uses. Fibers may also be produced through manual or mechanical decortication causing the release of fiber bundles. Decortication processes typically comprise a series of unit operations performed on one or more dicotyledonous plant stalks by various mechanical apparatus for primary recovery of the fibers through destruction of the stem or plant part containing the fiber. Such operations generally include: breaking, decortication, and cleaning. Primary separation of the bast from the hurd is typically done by a series of mechanical operations through imposing stress on the plant stalk through squeezing and breaking. Stresses imposed on the fiber through this process create conditions that may lead to breaking of fiber, low yield due to misalignment of the fiber in the apparatus, hurd contamination, and inefficient separation of the phloem.

Normal stress critical to the breaking operation must be applied so as to compress the stalks, thereby creating fissures along the major axis in order to break, crush, and divide the stalk into longitudinal sections, and then, just prior to stretching, breaking each section along a plane perpendicular to the major axis in alignment with and along the major axis of the stalk. These breaking, crushing, and stretching operations must not be done with excessive force that would prevent subsequent shear forces from separating the bast from the woody stalk material. Such mechanical actions by various apparatus for this purpose generally do so through the use of a plurality of corrugated rollers, beaters, shredders, and rubbing devices opposing or along the flow of stalks through the apparatus.

Critical to the operation is proper application of stress on a plurality of stalks being processed through an apparatus for the purpose of aligning and separating stalk bundles to create uniform feed through the apparatus, thereby allowing for uniform application of stress along planes parallel and perpendicular to the major axis of the stalks so as to produce uniform fracturing along both the longitudinal and transverse axis of the plant stalks. Known systems and method of plant stalk decortication generally do not achieve these objectives in an efficient manner.

Accordingly, a need exists in the art for an improved device, system, and method for decortication of plant stalks.

SUMMARY

In one aspect, a plant stalk decortication apparatus is provided. The apparatus comprises a plant stalk alignment system that longitudinally aligns the stalks with an axis of a bed as the system conveys the stalks along the bed. The alignment system comprises a plurality of rotating spindles disposed horizontally over the horizontal bed, which is preferably a fixed bed. Each spindle extends transversely across the bed in a direction perpendicular to the axis of the bed, which is parallel to a direction of conveyance of the plant stalks along the bed. Each spindle has a plurality of radially extending blades attached to the spindle in a spaced relation along a length of the spindle. Each blade is preferably a circular blade having a plurality of teeth disposed around an outer perimeter of the blade. The plurality of spindles are arranged along the direction of conveyance so that the blades of each spindle are intermeshed with the blades of adjacent spindles. Thus, the blades of one spindle fit within the spaces between the blades of the adjacent spindles. There is a nominal clearance between the bed and the lowermost edge of each of the blades. All of the spindles rotate simultaneously in the same direction with each of the blades attached to the spindles rotating parallel to the direction of conveyance of the plant stalks on the bed. Because of the intermeshing arrangement of the plurality of parallel rotating blades, the plant stalks automatically become longitudinally aligned with the blades and thus with the axis of the bed. The intermeshing blade arrangement also prevents the plant stalks from being lifted off of the bed by the rotating blades. The continuous rotation of the blades causes all of the stalks to become longitudinally aligned on the bed parallel to the axis of the bed as the rotating blades convey the stalks downstream to other components of the apparatus for applying stress to the stalks for decortication. In a preferred embodiment, the alignment system is configured such that the relative speed of rotation of downstream spindles is faster than the speed of rotation of upstream spindles relative to the direction of conveyance of the plant stalks on the bed so that the speed of rotation of successive spindles increases as the plant stalks move along the direction of conveyance on the bed, which aids in conveying the stalks along the bed. By aligning the stalks on the feed bed, the system creates a uniform feed stream of plant stalks through the apparatus, which allows for uniform application of stress along planes both parallel and perpendicular to a longitudinal axis of each stalk so as to produce uniform fracturing along both the longitudinal and transverse axis of each plant stalk.

In a preferred embodiment, the apparatus further comprises a pair of rotating opposing crushing rollers downstream of the plurality of spindles and a pair of rotating opposing breakers downstream of the rollers. The rollers are each disposed in a position transverse to the bed and are operatively connected to a motor configured to drive rotation of the opposing rollers in opposite directions. The breakers are also disposed in a position transverse to the bed. Each breaker comprises a plurality of spaced blades each attached to a rod. The blades extend longitudinally along the length of the rod and radially outward from the rod around the circumference of the rod. Each breaker is also operatively connected to a motor configured to drive rotation of the opposing breakers in opposite directions. The opposing breakers are spaced so that the blades of the breakers continuously intermesh with each other as the breakers rotate in opposite directions.

The rotating blades of the alignment system convey the plant stalks to the crushing rollers, which then convey the stalks to the breakers. The stalks are crushed by the rollers as they pass between the opposing rollers, which applies stress to the stalks to help separate the bast fiber from the woody hurd material. The stalks then pass between the breakers. As the stalks move between the opposing breakers, the longitudinal intermeshing blades on the breakers break the hurd portion of the plant stalks into shorter lengths.

In a preferred embodiment, the apparatus further comprises a suction chamber fluidly connected to an outlet of the opposing breakers. A fan may then be used to suck the bast fibers of the stalks into the suction chamber as the hurd chips are discharged downward from the breakers, thereby separating the bast from the hurd. Thus, in a preferred embodiment, the plant stalk decortication apparatus comprises components that perform a series of operations on a plurality of plant stalks, such as dicotyledonous plants, in order to effectively and efficiently separate and sort phloem fibers (bast) and inner woody core and short fibers contained in the core or stem of the plant (hurd). These components may perform operations on the plant stalks in series as the stalks are conveyed through the apparatus.

The apparatus produces longitudinal alignment of plant stalks as the stalks are conveyed along the bed by the rotating spindles and blades such that forces applied through subsequent action by the crushing rollers and the breakers is performed first longitudinally along the length each of the stalks and subsequently perpendicularly to the longitudinal axis of the stalks. The apparatus may also align and distribute woody stalks within the apparatus such that pressure applied through the use of rollers is distributed along a horizontal plane so as to create uniform stresses within the stalk sufficient for breaking the inner woody core into uniform chips or particles, which may then be separated from the bast fiber. The apparatus may further provide both mechanical and pneumatic action of physically separating and recovering both the hurd and bast fiber into separate streams after deconstruction of the plant stalks.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
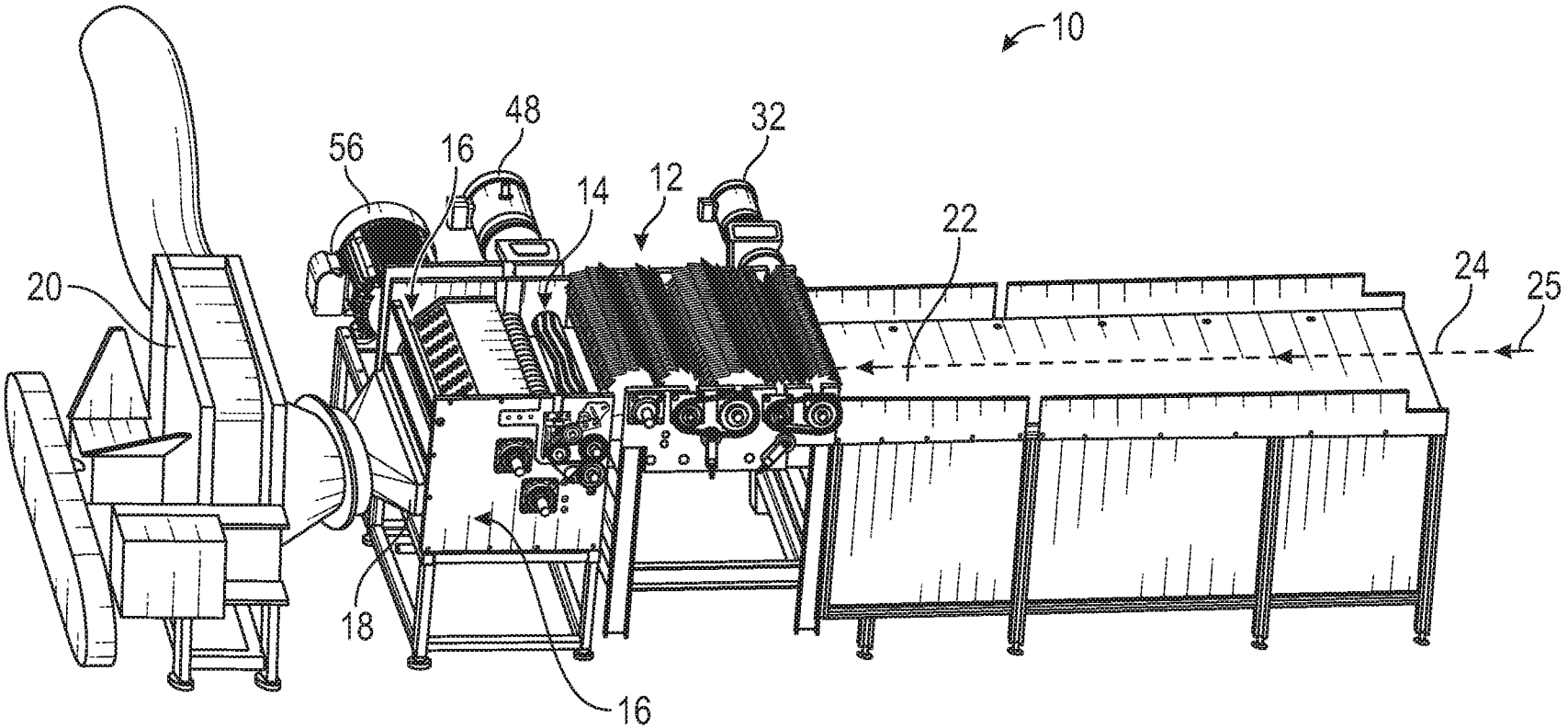
FIG. 1 shows a perspective view of a decortication apparatus in accordance with the present disclosure.
Figure 2:
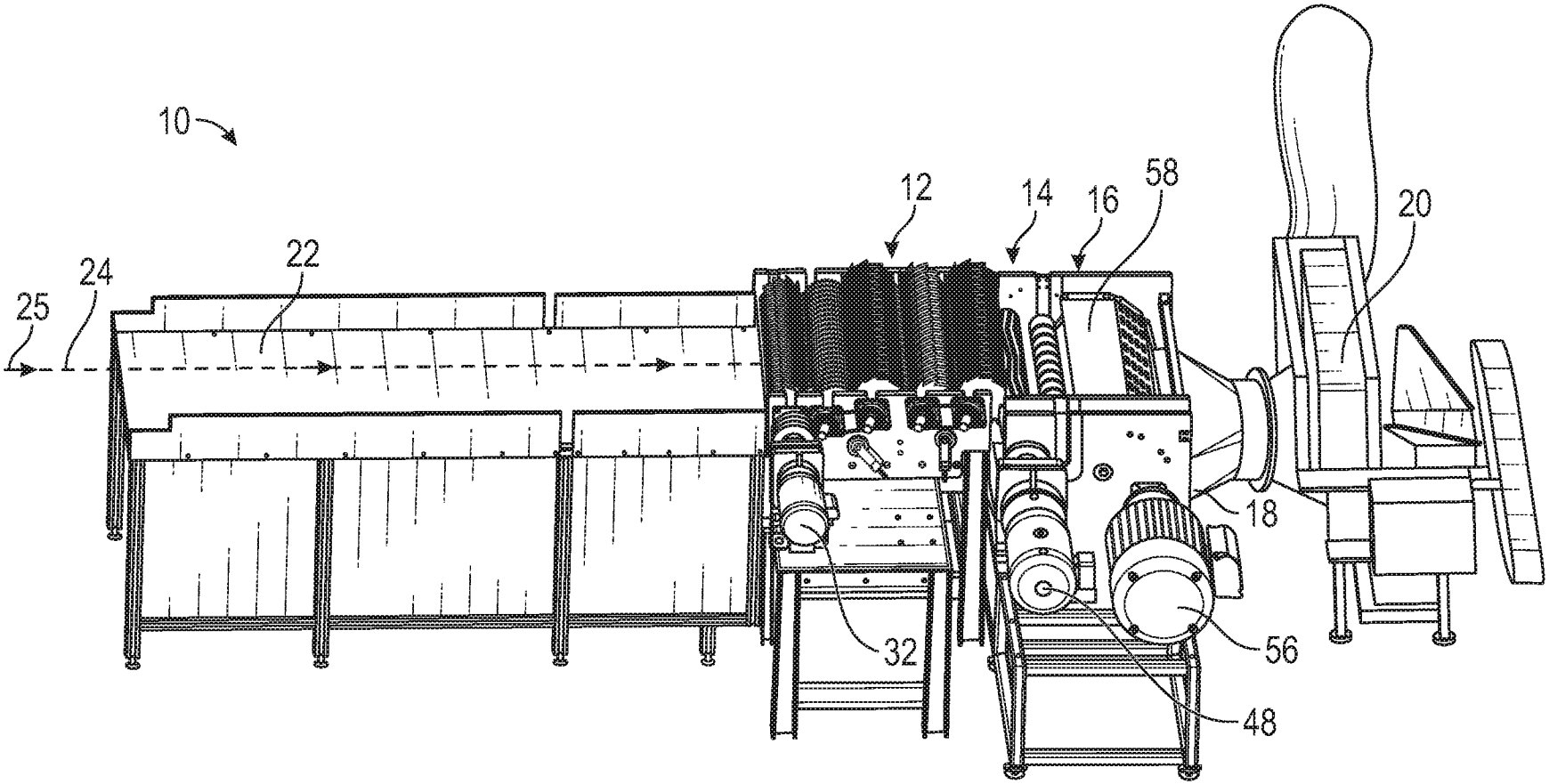
FIG. 2 shows a perspective view of a decortication apparatus in accordance with the present disclosure.
Figure 3:
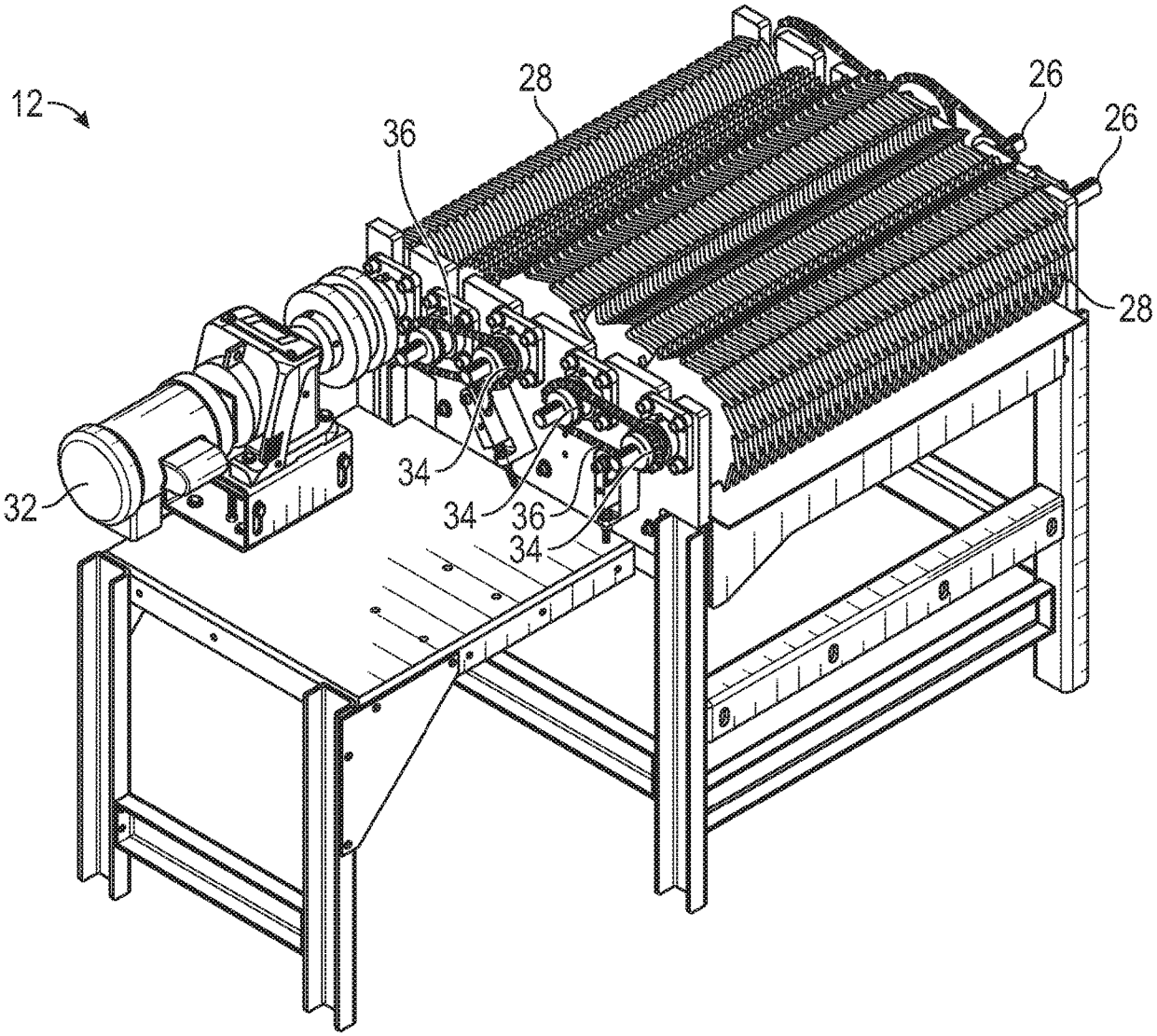
FIG. 3 shows a perspective view of a plant stalk alignment system of a decortication apparatus in accordance with the present disclosure.
Figure 4:
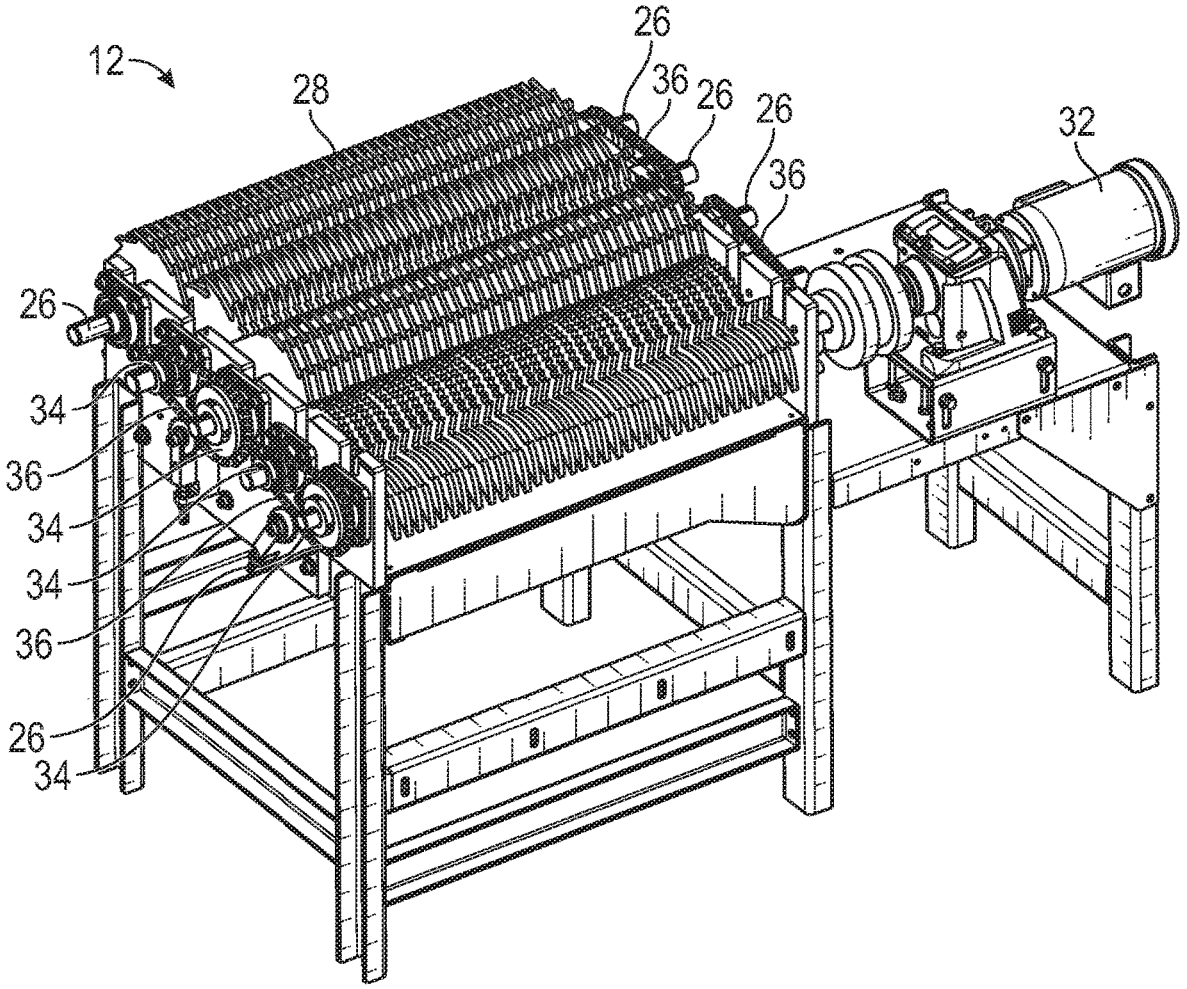
FIG. 4 shows a perspective view of a plant stalk alignment system of a decortication apparatus in accordance with the present disclosure.
Figure 5:
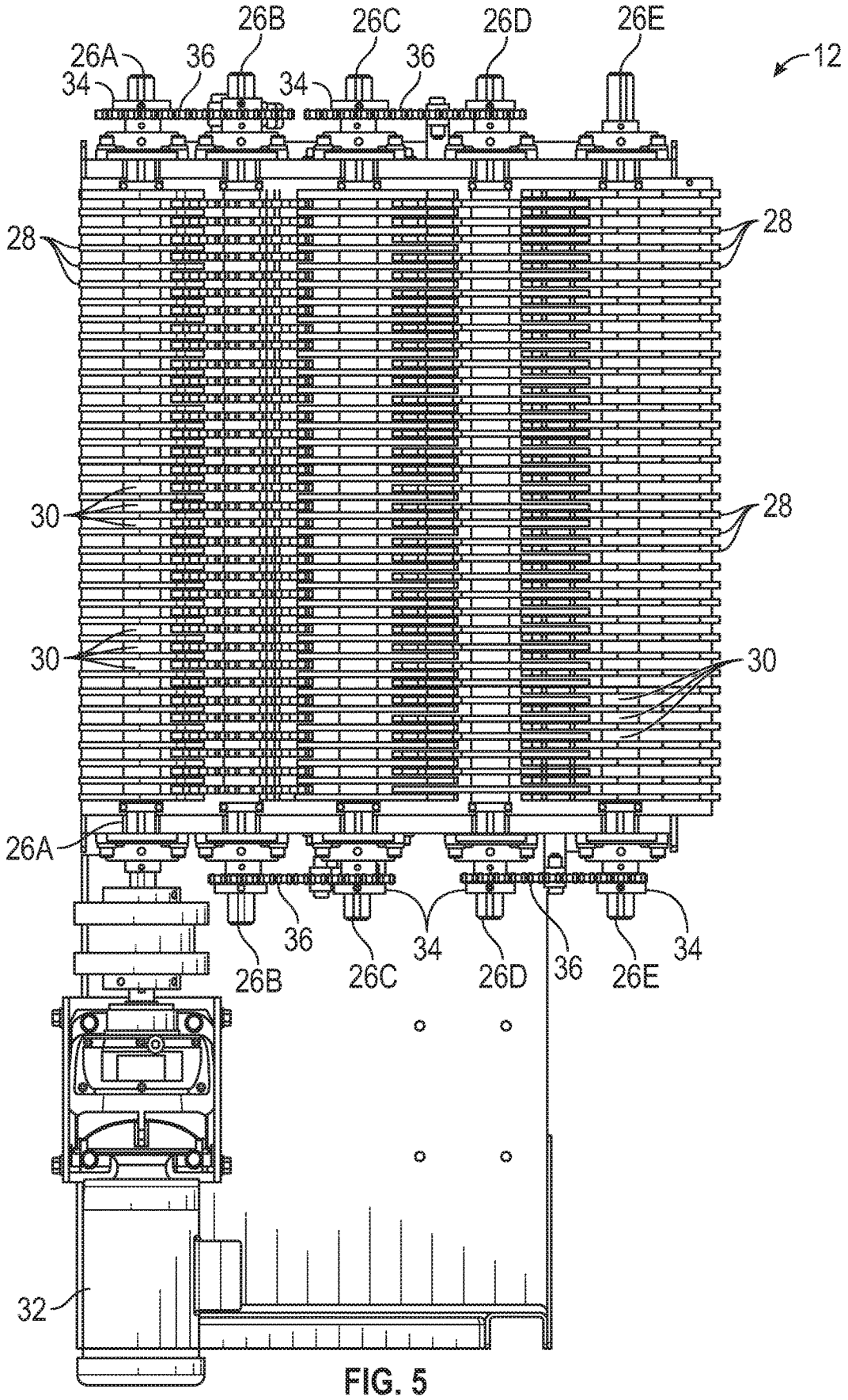
FIG. 5 shows a perspective view of a plant stalk alignment system of a decortication apparatus in accordance with the present disclosure.

In one aspect, as shown in FIGS. 1 and 2, a plant stalk decortication apparatus 10 is provided. The apparatus 10 comprises a plant stalk alignment system 12 that longitudinally aligns plant stalks along an axis 24 of a bed 22 as the apparatus conveys the stalks along the bed 22 in a direction of conveyance, as indicated by arrow 25 in FIGS. 1 and 2. The alignment system 12 comprises a plurality of rotating spindles 26 disposed horizontally over the horizontal bed 22, which is preferably a fixed bed. FIGS. 3-5 illustrate the alignment system 12. Each spindle 26 extends transversely across the bed 22 in a direction perpendicular to the axis 24 of the bed, which is parallel to the direction 25 of conveyance of the plant stalks along the bed 22. Each spindle 26 has a plurality of radially extending blades 28 attached to the spindle 26 in a spaced relation along a length of the spindle. Each blade 28 is preferably a circular blade arranged circumferentially around the spindle 26 and perpendicular to the spindle 26. Each circular blade 28 preferably has a plurality of teeth 38 disposed around an outer perimeter of the blade 28. FIGS. 6A-6D illustrate preferred embodiments of blades 28 that may be utilized.

As shown in FIGS. 3-5, the plurality of spindles 26 are arranged along the direction 25 of conveyance so that the blades 28 of each spindle 26 are intermeshed with the blades 28 of adjacent spindles 26. Thus, the blades 28 of one spindle 26 fit within the spaces between the blades 28 of the adjacent spindles 26, as best seen in FIG. 5. The spindles 26 are mounted so that there is a nominal clearance between the bed 22 and the lowermost edge of each of the blades 28 so that the plant stalks may narrowly pass between the teeth 38 and the bed 22 with the teeth 38 of the blades 28 contacting each plant stalk that is laying flat against the bed 22. The clearance between the bed 22 and the lowermost edge of each of the blades 28 is preferably adjustable. The clearance may be adjustable through vertical sliding bearing mounting blocks holding the spindle bearings or any other mechanism suitable for vertical adjustment.

All of the spindles 26 rotate simultaneously in the same direction with each of the blades 28 attached to the spindles 26 rotating parallel to the direction 25 of conveyance of the plant stalks on the bed 22. Because of the intermeshing arrangement of the plurality of parallel rotating blades 28, the plant stalks automatically become longitudinally aligned with the blades 28 and thus with the axis 24 of the bed 22. As best seen in FIG. 5, there is only nominal clearance between each of the intermeshing blades 28 and between the outer edge of each blade 28 and the adjacent spindle 26. Thus, the intermeshing blade arrangement allows little room between blades 28 and allows multiple blades 28 in series to contact each individual stalk, which prevents the plant stalks from being lifted off of the bed by the rotating blades 28. The continuous rotation of the blades 28 causes all of the plant stalks to become longitudinally aligned on the bed 22 parallel to the axis 24 as the rotating blades 28 also convey the stalks downstream along the direction 25 of conveyance.

Each spindle 26 is operatively connected to a motor 32 configured to drive rotation of the spindle 26. Each of the spindles 26 rotates simultaneously in the same direction during normal operation of the apparatus 10. In a preferred embodiment, as shown in FIGS. 3-5, the alignment system 12 preferably utilizes a single motor 32 to drive all of the spindles 26. In alternative embodiments, multiple motors may be utilized to each drive one or more individual spindles. Additionally, in a preferred embodiment, the alignment system 12 is configured such that the relative speed of rotation of downstream spindles 26 is faster than the speed of rotation of upstream spindles 26 relative to the direction 25 of conveyance of the plant stalks on the bed 22. As seen in FIG. 5, the plurality of spindles 26 preferably comprises a first spindle 26A and a plurality of downstream spindles 26B-26E positioned in series in a downstream direction of the first spindle 26A relative to the direction 25 of conveyance. The apparatus 10 is configured such that the speed of rotation of each downstream spindle 26B-26E is faster than the speed of rotation of at least one spindle 26 in an upstream position. Increasing the rotation speed of successive spindles 26 as the stalks move downstream, along with the intermeshing blades 28 attached to the spindles, aids in conveying the stalks along the bed 22, in separating the bast fibers of the stalks from the hurd, and also in preventing the fibers from clumping, which increases efficiency by creating a uniform feed of plant stalks downstream from the alignment system 12.

In a preferred embodiment, as best seen in FIGS. 3-5, the alignment system 12 comprises a sprocket 34 secured to each spindle 26, and the sprocket 34 of each spindle 26 is operatively connected to the sprocket 34 of an adjacent spindle 26 via a chain 36. The sprockets 34 of two adjacent spindles 26 within the plurality of spindles 26 are sized relative to each other to cause the speed of rotation of the adjacent spindle 26 positioned downstream to be faster than the adjacent spindle 26 positioned upstream. A plurality of sprockets 34 and chains 36 may be utilized to operatively connect all of the spindles 26 to a single motor 32 to drive rotation of all of the spindles 26 by activating only one motor 32, which ensures consistent rotational speed of each spindle 26 relative to the other spindles. Thus, the rotational speed of the spindles 26 may be fixed relative to each other by utilizing sprockets 34 and chains 36, or alternatively by using gears, pulleys, belts, a gear box, or other suitable mechanisms. The motor 32 may preferably be configured to allow adjustable variation in rotational speed of the spindles 26.

FIGS. 3 and 4 illustrate opposing sides of the alignment system 12. In a preferred embodiment, five spindles 26A-26E are operatively connected to each other, although a plurality including more spindles or fewer spindles may be utilized. As shown in FIG. 4, the sprocket 34 of spindle 26A is preferably larger than the sprocket 34 of spindle 26B, thereby causing spindle 26B to rotate faster than spindle 26A. As shown in FIG. 3, the operatively connected sprockets 34 of spindles 26B and 26C may be the same size so that these adjacent spindles rotate at the same speed. Similarly, the sprocket 34 of spindle 26C is preferably larger than the sprocket 34 of spindle 26D, thereby causing spindle 26D to rotate faster than spindle 26C, and the operatively connected sprockets 34 of spindles 26D and 26E may be the same size so that these adjacent spindles rotate at the same speed. Thus, each successive spindle 26 along the direction 25 of conveyance as the stalks move downstream on the bed 22 rotates at the same speed or a faster speed than the adjacent upstream spindle. Preferably, all of the downstream spindles 26B-26E rotate faster than the first spindle 26A, and at least two of the downstream spindles rotate faster than the adjacent spindle positioned directly upstream. In one embodiment, each successive spindle may rotate faster than its adjacent upstream spindle.

Figure 6A:
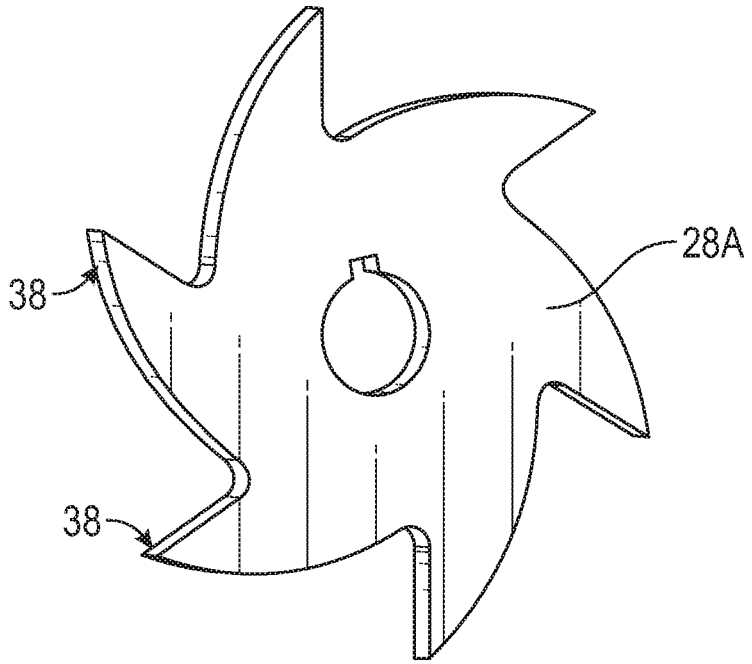
FIG. 6A shows a perspective view of a circular blade of a plant stalk alignment system in accordance with the present disclosure.
Figure 6B:
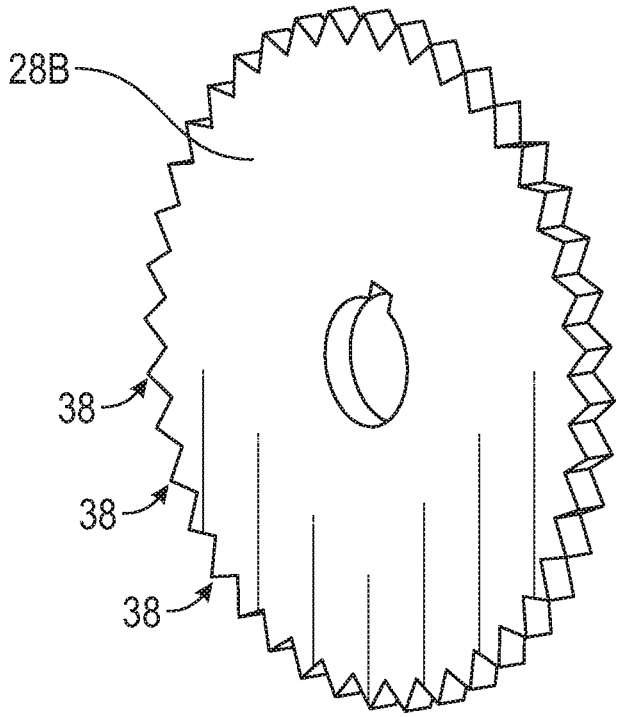
FIG. 6B shows a perspective view of a circular blade of a plant stalk alignment system in accordance with the present disclosure.
Figure 6C:
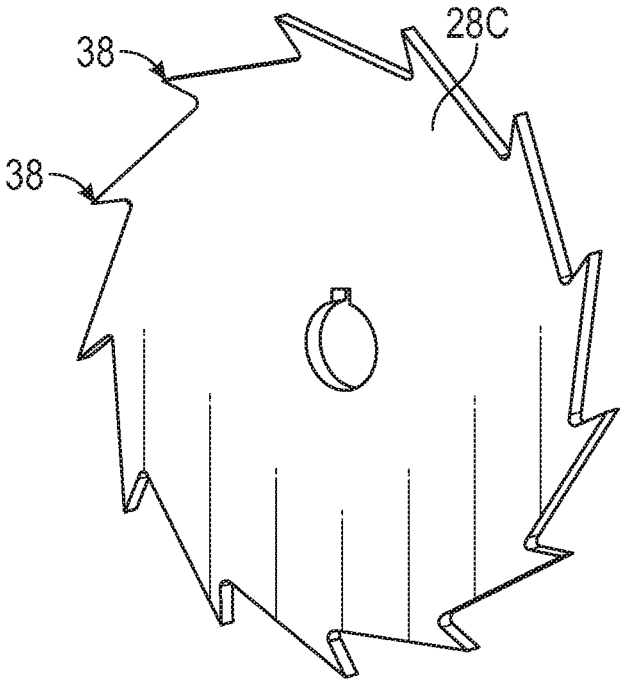
FIG. 6C shows a perspective view of a circular blade of a plant stalk alignment system in accordance with the present disclosure.
Figure 6D:
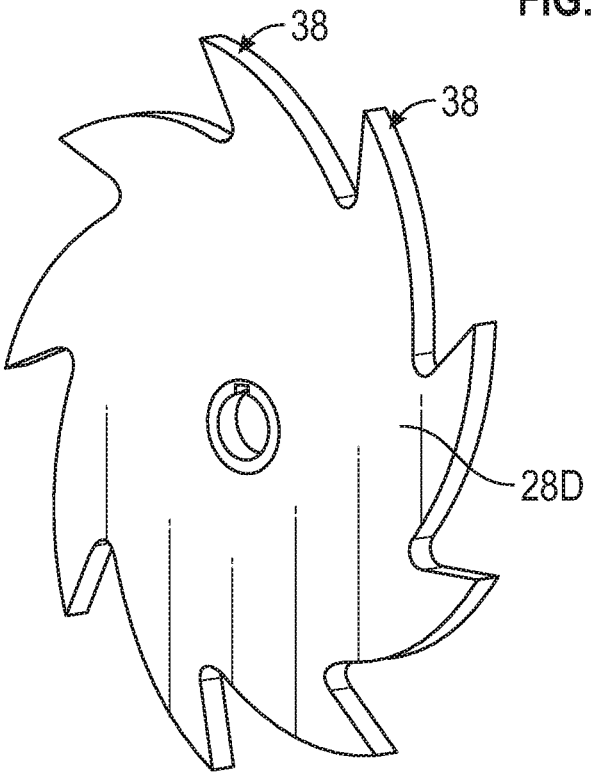
FIG. 6D shows a perspective view of a circular blade of a plant stalk alignment system in accordance with the present disclosure.
Figure 6E:
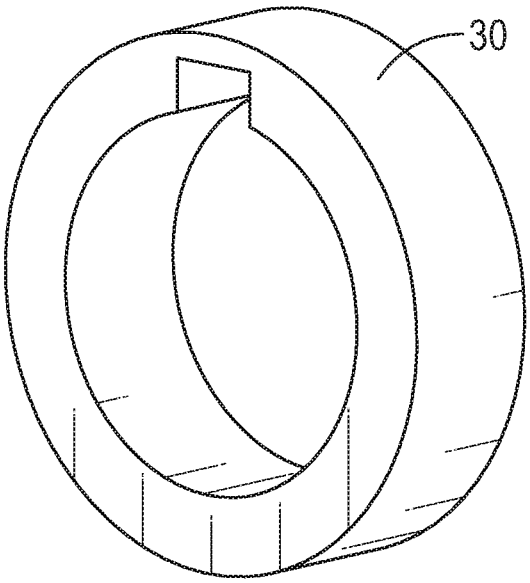
FIG. 6E shows a perspective view of a blade spacer of a plant stalk alignment system in accordance with the present disclosure.

In a preferred embodiment, as best seen in FIG. 4, each of the blades 28 of the first spindle 26A has forward facing teeth 38 relative to the direction of rotation. The blade 28A shown in FIG. 6A is preferably utilized on the first spindle 26A. The forward facing teeth may be utilized to pull plant stalks off of a bale of stalks placed onto the bed 22 and fed into the alignment system 12, or to pull loose stalks into the system. The forward facing teeth thus begin the process of pulling plant stalks onto the bed 22 and longitudinally aligning the stalks parallel to the axis 24 of the bed. The blade 28B shown in FIG. 6B is preferably utilized on the second spindle 26B. This blade 28B has symmetric outwardly facing teeth that score each of the stalks to facilitate downstream breaking of the hurd of the stalks. The blade 28C shown in FIG. 6C is preferably utilized on the third and fifth spindles 26C and 26E, and the blade 28D shown in FIG. 6D is preferably utilized on the fourth spindle 26D. The blades 28 all rotate in a clockwise direction when in the orientation shown in FIGS. 6A-6D. Thus, the blades 28C and 28D on spindles 26C, 26D, and 26E have rearward facing teeth 38 relative to the direction of rotation. In a preferred embodiment, as best seen in FIG. 5, the blades 28 are retained in a spaced relation along the length of each spindle 26 by installing a spacer 30, as shown in FIG. 6E, on the spindle 26 between each blade 28. Each spacer 30 is sized to provide sufficient clearance for the intermeshing blades 28 of an adjacent spindle 26 to fit between the blades 28 on each side of the spacer 30.

Figure 7:
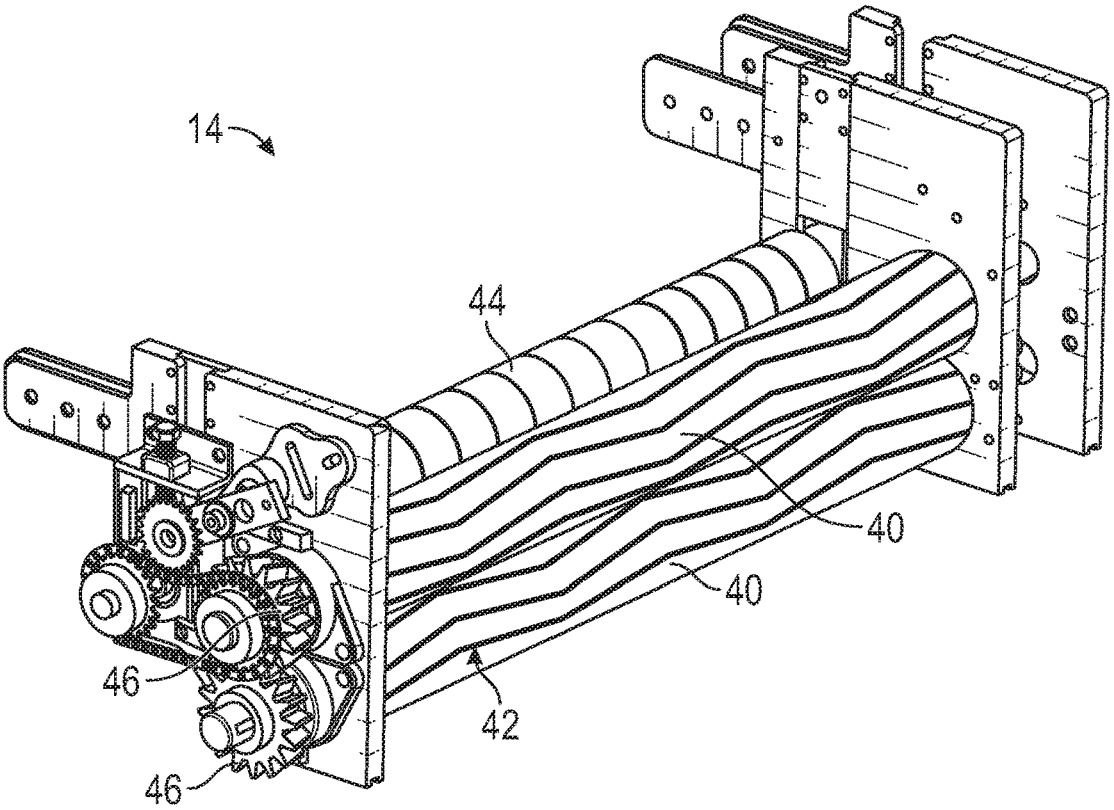
FIG. 7 shows a perspective view of a roller assembly of a decortication apparatus in accordance with the present disclosure.
Figure 9:
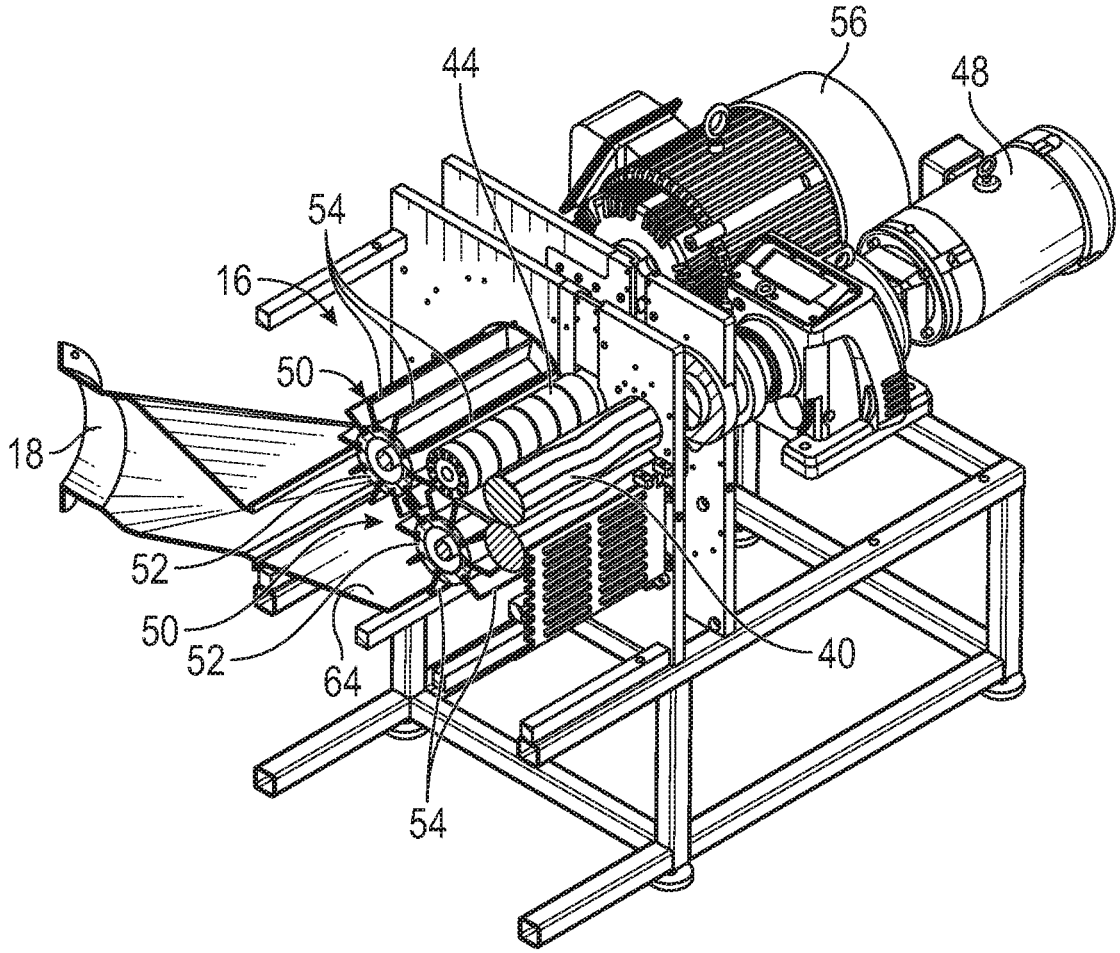
FIG. 9 shows a partial perspective view of a roller assembly and a breaker assembly of a decortication system in accordance with the present disclosure.

In a preferred embodiment, the apparatus 10 further comprises a roller assembly 14 downstream of the alignment system 12 and a breaker assembly 16 downstream of the roller assembly 14, as shown in FIGS. 1 and 2. The roller assembly 14 comprises a pair of rotating opposing crushing rollers 40 downstream of the plurality of spindles 26. The breaker assembly 16 comprises a pair of rotating opposing breakers 50 downstream of the rollers 40. FIG. 7 illustrates the roller assembly 14, and FIG. 9 illustrates the breaker assembly 16 adjacent to the roller assembly 14.

Figure 8:
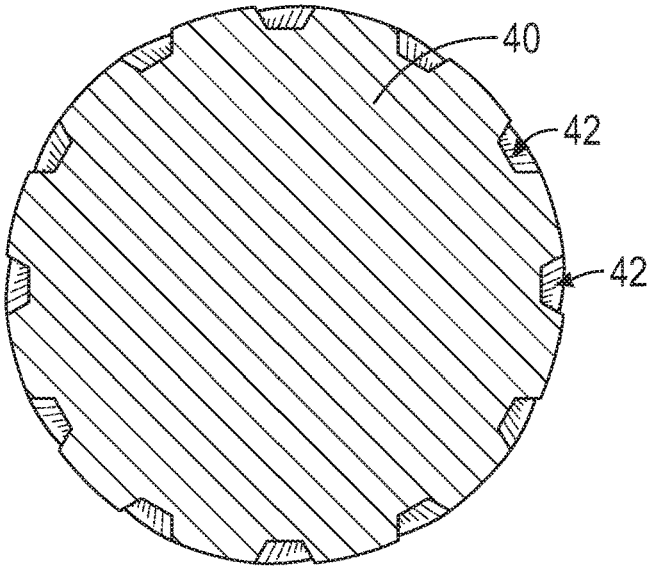
FIG. 8 shows a cross-sectional view of a roller in accordance with the present disclosure.

The rollers 40 are each disposed in a position transverse to the bed 22, as best seen in FIG. 1. The rollers 40 are operatively connected to a motor 48 configured to drive rotation of the opposing rollers 40 in opposite directions. In a preferred embodiment, as shown in FIG. 7, each roller 40 has a sprocket 46 secured to the roller so that a single motor 48 may be used to drive rotation of both rollers 40 in opposite directions. The teeth of the sprockets 46 mesh with each other so that rotation of one roller drives rotation of the other opposing roller. In a preferred embodiment, the roller assembly 14 also comprises a guide roller 44 positioned downstream of the opposing crushing rollers 40. The guide roller 44 guides the crushed plant stalks from the rollers 40 and between the opposing breakers 50. As shown in FIG. 7, the guide roller 44 preferably has a sprocket that is operably connected to the sprocket 46 of the upper roller 40 so that the motor 48 drives rotation of the guide roller 44 in the same direction as the upper crushing roller 40. FIG. 8 shows a cross section of one of the crushing rollers 40. Each of the opposing rollers 40 preferably has a plurality of longitudinal grooves 42 in the external surface of the roller 40 that are spaced around a circumference of the roller 40. The grooves 42 are preferably arranged in a zig-zagging pattern, as shown in FIG. 7, though the grooves may alternatively be arranged in other patterns, such as a spiral, helical, or straight array, or the rollers 40 may optionally have undulations to reduce stresses on the rollers. The grooves 42 are spaced such that shear planes are created by the grooves 42 within the plant stalk to produce hurd pieces of a desired length. In a preferred embodiment, as best seen in FIG. 8, each groove 42 is tapered with an inverse dovetail such that, in a transverse cross-section, the grove 42 forms a trapezoidal shape with the bottom (inner diameter) being shorter than the top (outer diameter). This groove 42 shape helps to prevent individual pieces of hurd from collecting in the groove and impairing the function of the roller 40.

Figure 10:
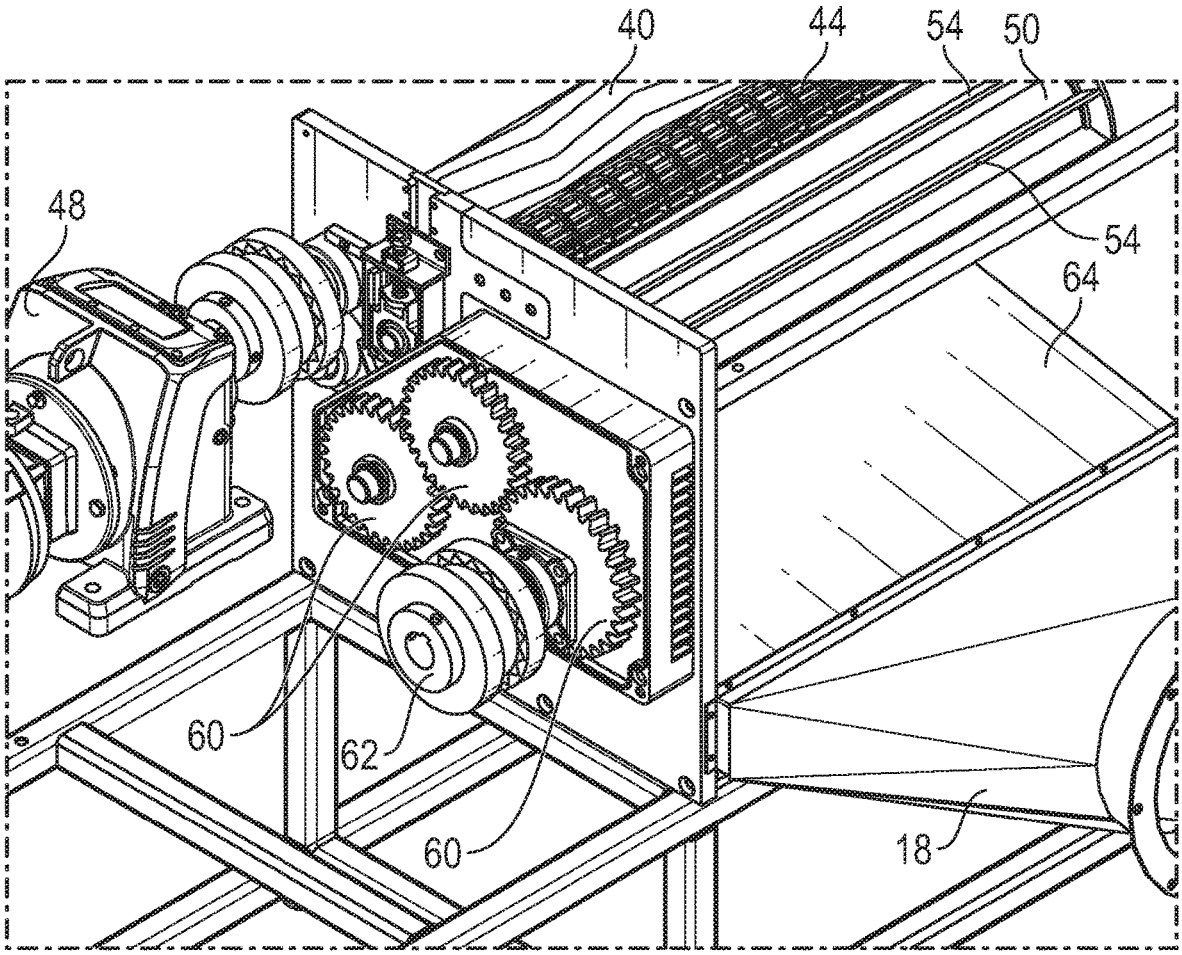
FIG. 10 shows a partial perspective view of a roller assembly and a breaker assembly of a decortication system in accordance with the present disclosure.

The breakers 50 are also disposed in a position transverse to the bed 22. Each breaker 50 comprises a plurality of spaced blades 54 each attached to a rod 52. These blades 54 are preferably blunted blades, as these blades are used for breaking rather than cutting the hurd material. The blades 54 extend longitudinally along the length of the rod 52 and radially outward from the rod 52 around the circumference of the rod. The opposing breakers 50 are spaced so that the blades 54 of the breakers 50 continuously intermesh with each other as the breakers 50 rotate in opposite directions, as best illustrated in FIG. 9, which shows a cross-sectional cutaway view of the breaker assembly 16 and adjacent roller assembly 14 to illustrate the internal components of these assemblies. Each breaker 50 is operatively connected to a motor 56 configured to drive rotation of the opposing breakers 50 in opposite directions. In the view shown in FIG. 9, the top breaker rotates in a clockwise direction, and the bottom breaker rotates in a counterclockwise direction. Similarly, the top roller rotates in a clockwise direction, and the bottom roller rotates in a counterclockwise direction. In a preferred embodiment, as shown in FIG. 10, each breaker 50 has a sprocket 60 secured to the breaker so that a single motor 56 may be used to drive rotation of both breakers 50. The teeth of the sprockets 60 mesh with each other so that rotation of one breaker drives rotation of the other opposing breaker in the opposite direction. To illustrate the breaker sprockets 60, FIG. 10 shows a motor connection point 62 to which the shaft of the breaker motor 56 may be connected, but with the motor 56 disconnected.

In a preferred embodiment, as best seen in FIGS. 1 and 2, the apparatus 10 further comprises a suction chamber 18 or duct fluidly connected to an outlet of the opposing breakers 50 and a blower 20 fluidly connected to the suction chamber 18. The blower 20 may be used to suck the bast fibers away from the breakers 50 in order to separate the bast fibers from the hurd of the plant stalks.

To use the apparatus 10, plant stalks are first loaded onto the bed 22 and fed into the intermeshing rotating blades 28 of the alignment system 12. The forward facing teeth 38 of the rotating blades 28 on the first spindle 26A pull the stalks into the alignment system 12. All of the rotating blades 28 on the spindles 26 work in concert to longitudinally align the plant stalks parallel to the axis 24 of the bed 22 and convey the stalks along the bed 22 to the crushing rollers 40. Thus, when the stalks are fed between the rollers 40, the longitudinal axis of each stalk is perpendicular to the rollers 40. The teeth 38 of the rotating blades 28 also compress and score the stalks as the stalks are conveyed. The configuration of the teeth 38 of blades 28A and 28B on spindles 26A and 26B allow these blades to function primarily in scoring the stalks. The teeth 38 of these blades 28A, 28B form initial fractures longitudinally along the length of the stalks. This cutting process also commences alignment of the stalks. As the stalks pass under the rotating teeth of each blade, the cutting action causes initial transverse compression fractures to form in the woody core, which forms initial perpendicular breakage planes for hurd chip formation.

The rotating blades 28 rotate parallel to the axis 24 and perpendicular to the upper surface of the bed 22, which also creates a combing action by the teeth 38 on the stalks being conveyed along the bed 22. The configuration of the rearward facing teeth 38 of blades 28C and 28D on spindles 26C, 26D, and 26E allow these blades to function primarily in combing the stalks, which aids in stretching the stalks and beginning to separate the bast fibers. Through the use of progressively faster rotating spindles 26 along the bed 22 of the apparatus 10, the plant stalks are aligned with the axis 24 of the bed 22 and also stretched and separated such that the stalks are both aligned and uniformly distributed along the bed 22 of the apparatus. A uniform feed of longitudinally aligned plant stalks to the downstream rollers 40 and breakers 50 increases the efficiency of the decortication process. The uniform action of the intermeshing rotating blades 28 also provides an initial application of force to the stalks to begin separating the fibers and breaking the woody core into sections longitudinally.

The rotating blades 28 convey the stalks to the crushing rollers 40, and the rollers 40 crush the stalks as the stalks pass perpendicularly between the opposing rollers 40, which applies stress to the stalks to help further separate the bast fiber from the woody hurd material. The rollers 40 create sufficient shear force for stretching and stripping the plant stalks, thereby causing the bast fiber and hurd to separate. Pressure applied by the rollers 40 is distributed along a horizontal plane so as to create uniform stresses within each of the stalks. The rotating rollers 40 then convey the plant stalks between the opposing breakers 50. The guide roller 44 is preferably utilized to guide the stalks between the breakers 50. The breakers 50 rotate simultaneously in opposite directions, thereby causing the crushed plant stalks to pass between the breakers 50 so that the longitudinal intermeshing blades 54 on the breakers 50 break the hurd portion of the plant stalks into shorter lengths. The blades 54 of the breakers 50 flex the bast fibers and apply force transverse to the longitudinal axis of the stalks that is sufficient to break the inner woody hurd material into uniform chips or particles that can be separated from the bast fiber. The bast fiber temporarily wraps around the breakers 50 while the heavier hurd material drops downward below the breakers 50. As best shown in FIG. 2, the breaker assembly 16 preferably includes a breaker cover 58 to contain any loose bast fibers. As shown in FIG. 9, the breaker assembly 16 preferably includes a sloped plate 64 that feeds bast fibers into the duct 18 for removal. The plate 64 does not extend below the bottom breaker 50 to allow the hurd chips to drop out. The hurd may then be collected separately from the bast fiber. The blower 20 then sucks the loose bast fiber away from the breakers 50 and into the suction chamber 18. The blower 20 may then discharge the loose fibers separate from the hurd chips.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. An apparatus comprising:

a plurality of rotating spindles disposed horizontally over a horizontal bed configured to receive plant stalks on an upper surface of the bed, wherein each spindle extends transversely across the bed in a direction perpendicular to an axis of the bed that is parallel to a direction of conveyance along the bed, wherein each spindle has a plurality of radially extending blades attached to the spindle in a spaced relation along a length of the spindle, wherein a lowermost edge of each of the blades of each spindle is disposed above the bed, wherein the blades are configured to convey the plant stalks along the upper surface of the bed in the direction of conveyance, wherein a clearance between the bed and the lowermost edge of each of the blades of each spindle is sized to allow the plant stalks to contact both the bed and the lowermost edge of each of the blades of each spindle, wherein the plurality of spindles are arranged along the direction of conveyance so that the blades of each spindle are intermeshed with the blades of an adjacent spindle, and wherein each spindle is configured to rotate in a same rotational direction;

a pair of rotating opposing crushing rollers each disposed in a position transverse to the bed, wherein each of the pair of crushing rollers is configured to rotate in an opposite direction of an opposing one of the crushing rollers, and wherein the pair of crushing rollers is disposed downstream of the plurality of rotating spindles along the direction of conveyance, wherein the pair of crushing rollers has a plurality of longitudinal grooves in an external surface of each respective one of the pair of crushing rollers, wherein the longitudinal grooves are spaced around a circumference of each respective one of the pair of crushing rollers; and a pair of rotating opposing breakers each disposed in a position transverse to the bed, wherein each of the pair of breakers comprises a plurality of spaced blades each attached to a rod and extending longitudinally along a length of the rod and radially outward from the rod around a circumference of the rod, wherein each of the pair of breakers is configured to rotate in an opposite direction of an opposing one of the breakers, wherein the pair of breakers are positioned relative to each other so that the blades of each respective one of the pair of breakers are intermeshed with the blades of an opposing one of the breakers, and wherein the pair of breakers is disposed downstream of the pair of crushing rollers along the direction of conveyance.

2. The apparatus of claim 1, wherein the plurality of spindles comprises a first spindle and a plurality of downstream spindles positioned in series downstream of the first spindle relative to the direction of conveyance, wherein the apparatus is configured such that a speed of rotation of each downstream spindle is faster than a speed of rotation of at least one spindle in an upstream position.

3. The apparatus of claim 2, wherein the apparatus comprises a sprocket secured to each spindle, wherein the sprocket of each spindle is operatively connected to the sprocket of an adjacent spindle via a chain, wherein the sprockets of two adjacent spindles within the plurality of spindles are sized relative to each other to cause a speed of rotation of a spindle positioned downstream to be faster than an adjacent spindle positioned upstream.

4. The apparatus of claim 1, wherein the clearance between the bed and the lowermost edge of each of the blades is adjustable.

5. The apparatus of claim 1, wherein a first spindle along the direction of conveyance has forward facing teeth relative to a direction of rotation of the first spindle.

6. The apparatus of claim 5, wherein a plurality of spindles positioned behind the first spindle in the direction of conveyance have rearward facing teeth relative to a direction of rotation of the spindles positioned behind the first spindle.

7. The apparatus of claim 1, wherein the apparatus further comprises a suction chamber fluidly connected to an outlet of the pair of breakers.

8. A method comprising steps of:

providing an apparatus comprising:

a plurality of rotating spindles disposed horizontally over a horizontal bed configured to receive plant stalks on an upper surface of the bed, wherein each spindle extends transversely across the bed in a direction perpendicular to an axis of the bed that is parallel to a direction of conveyance along the bed, wherein each spindle has a plurality of radially extending blades attached to the spindle in a spaced relation along a length of the spindle, wherein a lowermost edge of each of the blades of each spindle is disposed above the bed, wherein the blades are configured to convey the plant stalks along the upper surface of the bed in the direction of conveyance, wherein a clearance between the bed and the lowermost edge of each of the blades of each spindle is sized to allow the plant stalks to contact both the bed and the lowermost edge of each of the blades of each spindle, wherein the plurality of spindles are arranged along the direction of conveyance so that the blades of each spindle are intermeshed with the blades of an adjacent spindle, wherein each spindle is configured to rotate in a same rotational direction, a pair of rotating opposing crushing rollers each disposed in a position transverse to the bed, wherein each of the pair of crushing rollers is configured to rotate in an opposite direction of an opposing one of the crushing rollers, and wherein the pair of crushing rollers is disposed downstream of the plurality of rotating spindles along the direction of conveyance, wherein the pair of crushing rollers has a plurality of longitudinal grooves in an external surface of each respective one of the pair of crushing rollers, wherein the longitudinal grooves are spaced around a circumference of each respective one of the pair of crushing rollers, and a pair of rotating opposing breakers each disposed in a position transverse to the bed, wherein each of the pair of breakers comprises a plurality of spaced blades each attached to a rod and extending longitudinally along a length of the rod and radially outward from the rod around a circumference of the rod, wherein each of the pair of breakers is configured to rotate in an opposite direction of an opposing one of the breakers, wherein the pair of breakers are positioned relative to each other so that the blades of each respective one of the pair of breakers are intermeshed with the blades of an opposing one of the breakers, and wherein the pair of breakers is disposed downstream of the pair of crushing rollers along the direction of conveyance;

causing each spindle to rotate simultaneously in the same rotational direction;

feeding plant stalks onto the bed in the direction of conveyance so that the plant stalks contact the blades of a first spindle of the plurality of spindles, wherein the rotating plurality of spindles cause the plant stalks to be conveyed on the bed along the direction of conveyance to the pair of crushing rollers and to become longitudinally aligned with the axis of the bed;

causing the pair of crushing rollers to rotate simultaneously in opposite directions, thereby causing the plant stalks to pass between the pair of crushing rollers so that the pair of crushing rollers crush the plant stalks;

feeding the plant stalks from the crushing rollers to the breakers; and causing the pair of breakers to rotate simultaneously in opposite directions, thereby causing the crushed plant stalks to pass between the pair of breakers so that the pair of breakers break a hurd portion of the plant stalks into shorter lengths.

9. The method of claim 8, wherein the plurality of spindles comprises the first spindle and a plurality of downstream spindles positioned in series downstream of the first spindle relative to the direction of conveyance, wherein the apparatus is configured such that a speed of rotation of each downstream spindle is faster than a speed of rotation of at least one spindle in an upstream position, wherein the step of causing each spindle to rotate simultaneously comprises causing each downstream spindle to rotate at a faster speed than at least one spindle in an upstream position.

10. The method of claim 9, wherein the apparatus comprises a sprocket secured to each spindle, wherein the sprocket of each spindle is operatively connected to the sprocket of an adjacent spindle via a chain, wherein the sprockets of two adjacent spindles within the plurality of spindles are sized relative to each other to cause a speed of rotation of a spindle positioned downstream to be faster than an adjacent spindle positioned upstream.

11. The method of claim 8, wherein the clearance between the bed and the lowermost edge of each of the blades is adjustable, wherein the method further comprises a step of adjusting the clearance so that the lowermost edge of each of the blades contacts the plant stalks on the bed.

12. The method of claim 8, wherein the first spindle has forward facing teeth relative to a direction of rotation of the first spindle.

13. The method of claim 12, wherein a plurality of spindles positioned behind the first spindle in the direction of conveyance have rearward facing teeth relative to a direction of rotation of the spindles positioned behind the first spindle.

14. The method of claim 8, wherein the apparatus further comprises a suction chamber fluidly connected to an outlet of the pair of breakers, wherein the method further comprises a step of activating a fan to suck fibers of the plant stalks into the suction chamber, thereby separating the fibers from the hurd portion.

* * * * *